US010207517B1

(12) United States Patent
Arakane

(10) Patent No.: US 10,207,517 B1
(45) Date of Patent: Feb. 19, 2019

(54) IMAGE RECORDING APPARATUS

(71) Applicant: Brother Kogyo Kabushiki Kaisha, Nagoya-shi, Aichi-ken (JP)

(72) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/936,545

(22) Filed: Mar. 27, 2018

(30) Foreign Application Priority Data

Sep. 29, 2017 (JP) ..... 2017-191483

(51) Int. Cl.
*B41J 29/393* (2006.01)
*B41J 29/38* (2006.01)
*B41J 2/21* (2006.01)
*B41J 25/00* (2006.01)

(52) U.S. Cl.
CPC ..... *B41J 2/2135* (2013.01); *B41J 25/001* (2013.01); *B41J 29/38* (2013.01)

(58) Field of Classification Search
CPC ..... B41J 2/2135; B41J 29/38; B41J 25/001
USPC ..... 347/5, 9, 14, 19
See application file for complete search history.

(56) References Cited

U.S. PATENT DOCUMENTS 7,552,984 B2 * 6/2009 Hayashi ..... B41J 19/145 347/12
9,561,667 B2 2/2017 Yoshida
9,630,422 B2 * 4/2017 Yoshida ..... B41J 2/5056
10,052,897 B2 * 8/2018 Gonzalez Bruno ..... G06K 15/1868
2016/0243862 A1 8/2016 Yoshida

FOREIGN PATENT DOCUMENTS

JP 2016-153182 A 8/2016

* cited by examiner

*Primary Examiner* — An Do
(74) *Attorney, Agent, or Firm* — Banner & Witcoff, Ltd.

(57) ABSTRACT

An image recording apparatus is configured to record an image which includes multi-pass recording of completing a line image by performing a recording pass a plurality of number of times. The recording processing is configured to be executed in: a first recording mode in which the multi-pass recording of completing the line image is executed by performing the recording pass a first number of times, the recording pass being performed only when moving a carriage toward one side in a scanning direction; and a second recording mode in which the multi-pass recording of completing the line image is executed by performing the recording pass a second number of times larger than the first number of times, the recording pass being performed when moving the carriage toward the one side in the scanning direction and another side in the scanning direction.

11 Claims, 9 Drawing Sheets

FIRST NORMAL RECORDING MODE (TWO-PASS/MULTI-PASS PROCESSING)

USING RATIO OF NOZZLES IN FIRST NORMAL RECORDING MODE (TWO-PASS/MULTI-PASS PROCESSING)

SECOND NORMAL RECORDING MODE (THREE-PASS/MULTI-PASS PROCESSING)

USING RATIO OF NOZZLES IN SECOND NORMAL RECORDING MODE (THREE-PASS/MULTI-PASS PROCESSING)

FIG. 7A

| RECORDING MODE | NUMBER OF TIMES OF RECORDING PASSES TO COMPLETE ONE LINE IMAGE | RECORDING METHOD (RECORDING DIRECTION) | MOVING SPEED OF CARRIAGE |
|---|---|---|---|
| FIRST NORMAL RECORDING MODE | TWO TIMES | UNIDIRECTIONAL RECORDING | NORMAL |
| SECOND NORMAL RECORDING MODE | THREE TIMES | BIDIRECTIONAL RECORDING | NORMAL |
| HIGH-QUALITY RECORDING MODE | THREE TIMES | UNIDIRECTIONAL RECORDING | NORMAL |
| HIGH-SPEED RECORDING MODE | ONCE | BIDIRECTIONAL RECORDING | HIGH-SPEED |

FIG. 7B

| RECORDING INSTRUCTION CONDITION | SHEET TYPE CONDITION | RECORDING MODE |
|---|---|---|
| NORMAL RECORDING INSTRUCTION | INKJET SHEET | FIRST NORMAL RECORDING MODE |
| | GLOSSY SHEET | SECOND NORMAL RECORDING MODE |
| HIGH-QUALITY RECORDING INSTRUCTION | – | HIGH-QUALITY RECORDING MODE |
| HIGH-SPEED RECORDING INSTRUCTION | – | HIGH-SPEED RECORDING MODE |

IMAGE RECORDING APPARATUS

CROSS-REFERENCE TO RELATED APPLICATIONS

This application claims priority from Japanese Patent Application No. 2017-191483 filed on Sep. 29, 2017, the entire contents of which are incorporated herein by reference.

TECHNICAL FIELD

The present disclosure relates to an image recording apparatus.

BACKGROUND

As an example of an image recording apparatus, related art discloses an inkjet recording apparatus configured to record an image by repetitively performing a scanning operation (recording pass) of discharging ink from a plurality of nozzles while moving a carriage, on which a recording head having the nozzles is mounted, in a scanning direction, and a sheet conveying operation. In the inkjet recording apparatus, there is a problem that a stripe-shaped density irregularity (for example, a white stripe) is generated in the scanning direction on a sheet due to a conveyance error. As measures against the stripe-shaped density irregularity, the related art discloses an image recording by a multi-pass recording method of completing an image of one line to be recorded on the sheet in the scanning direction by recording a thinned-out image by using different nozzles in each of a plurality of recording passes.

As the image recording apparatus of the above type, an image recording apparatus has been suggested which is configured to execute unidirectional recording, in which the recording pass is performed by discharging the ink from the nozzles only when the carriage is moved toward one side in the scanning direction, and bidirectional recording, in which the recording pass is performed by discharging the ink from the nozzles when the carriage is moved toward one side and another side in the scanning direction. In the unidirectional recording, a quality of an image to be recorded on a sheet is higher but the throughput is lowered, as compared to the bidirectional recording.

Also, the stripe-shaped density irregularity in the scanning direction may be generated due to diverse factors, in addition to the conveyance error. For example, in a case where a nozzle shift (bending of a flight course of the discharged ink droplets) occurs, the stripe-shaped density irregularity in the scanning direction may be generated. As measures against the stripe-shaped density irregularity due to the nozzle shift, it is useful to record an image by the multi-pass recording method as described above. Also, in a case where an amount of the nozzle shift is large, it is possible to further diminish the stripe-shaped density irregularity by increasing the number of times of the recording passes upon recording of an image of one line. However, when the number of times of the recording passes is increased, the throughput is lowered. Therefore, for example, when an image is recorded on the sheet by the unidirectional recording and the number of times of the recording passes upon recording of an image of one line is increased, the throughput may be largely lowered.

SUMMARY

It is therefore an object of the present disclosure to provide an image recording apparatus capable of suppressing lowering of the throughput while suppressing deterioration of a quality of an image to be recorded on a medium.

According to an aspect of the disclosure, there is provided an image recording apparatus including: a conveyer configured to convey a medium in a conveying direction; a recording head including a nozzle row including a plurality of nozzles aligned in the conveying direction; a carriage on which the recording head is mounted, the carriage being configured to reciprocally move in a scanning direction intersecting with the conveying direction; and a controller configured to: record an image on the medium by alternately performing: a recording pass of causing the recording head to discharge liquid from the nozzles toward the medium while moving the carriage in the scanning direction; and conveying of causing the conveyer to convey the medium in the conveying direction, wherein the recording of the image includes multi-pass recording of completing a line image by performing the recording pass a plurality of number of times, the line image being an image of one line extending in the scanning direction to be recorded on the medium, each recording pass being performed by recording a thinned-out image on the medium by using a nozzle among the plurality of nozzles, and a nozzle used in one recording pass being different from a nozzle used in another recording pass, and wherein the controller is configured to record the image in: a first recording mode in which the multi-pass recording of completing the line image is executed by performing the recording pass a first number of times, the recording pass being performed only when moving the carriage toward one side in the scanning direction; and a second recording mode in which the multi-pass recording of completing the line image is executed by performing the recording pass a second number of times larger than the first number of times, the recording pass being performed when moving the carriage toward the one side in the scanning direction and another side in the scanning direction.

According to the aspect of the present disclosure, in the second recording mode, since the number of times of the recording passes is large, it is possible to suppress generation of the stripe-shaped density irregularity in the scanning direction on the medium. Also, in the second recording mode, since the recording pass is performed when moving the carriage toward the one side and the other side in the scanning direction, it is possible to suppress lowering of the throughput.

On the other hand, in the first recording mode, since the number of times of the recording passes is small, it is possible to suppress lowering of the throughput. Also, in the first recording mode, since the recording pass is performed only when moving the carriage toward one side in the scanning direction, it is possible to suppress the liquid spotting position on the medium from deviating with respect to the scanning direction, as compared to the second recording mode.

BRIEF DESCRIPTION OF DRAWINGS

FIG. 7A illustrates recording modes;

FIG. 7B illustrates a condition for determining the recording mode; and

DETAILED DESCRIPTION

Figure 1:
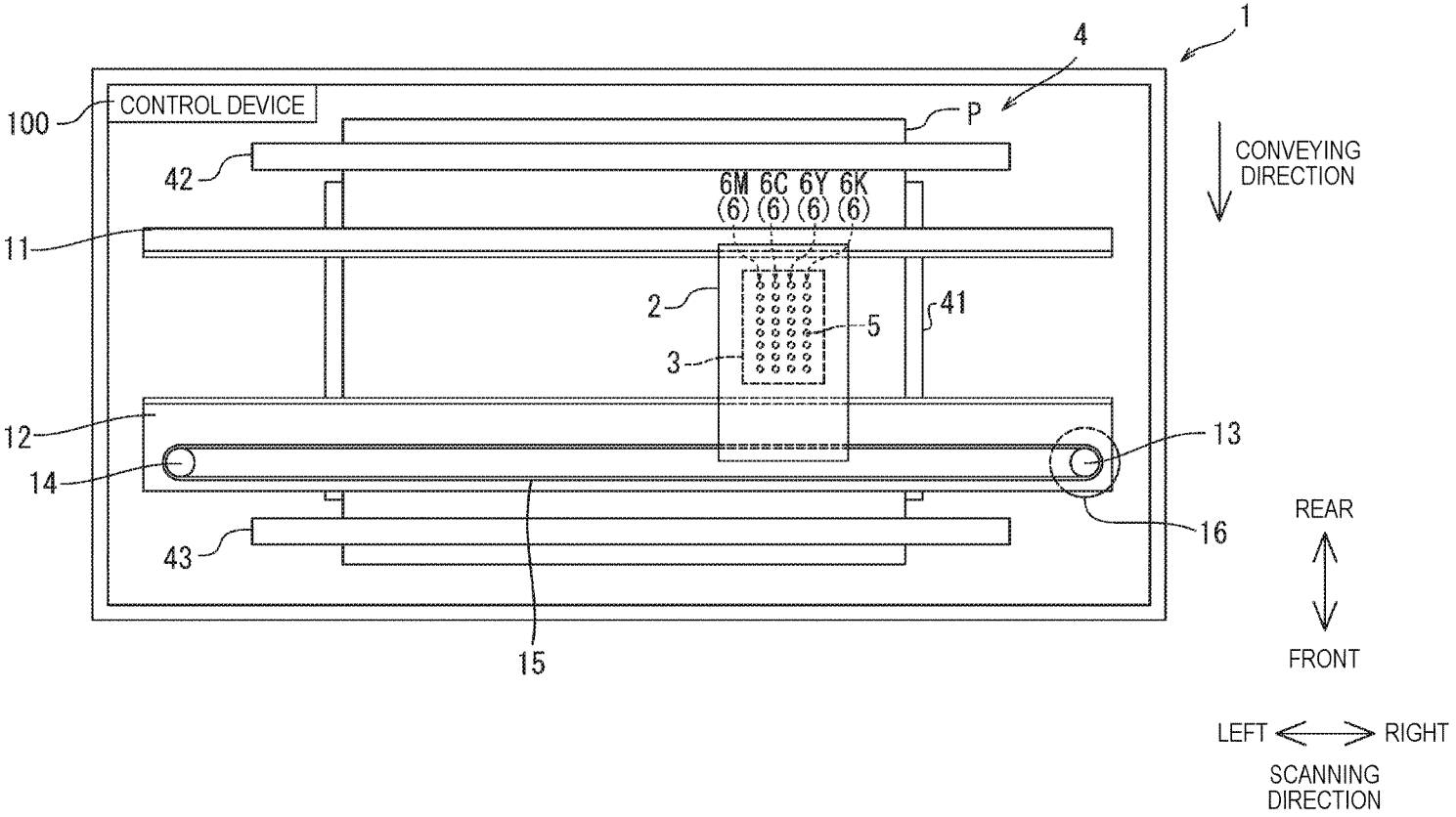
FIG. 1 is a schematic plan view of an inkjet printer.

Hereinafter, an inkjet printer 1 is exemplified as the image recording apparatus. As shown in FIG. 1, the inkjet printer 1 includes a carriage 2, an inkjet head 3, a conveyance mechanism 4, a touch panel 90 (refer to FIG. 2A), an image reading mechanism 95 (refer to FIG. 2A), a control device 100, and the like. Hereinafter, the front and rear direction and the right and left direction, which are shown in FIG. 1 and are orthogonal to each other, are defined as "front and rear direction" and "right and left direction" of the printer 1. The following descriptions are made while appropriately using the terms of the front and rear direction and the right and left direction.

The carriage 2 is supported to two guide rails 11, 12 extending in the right and left direction so as to be moveable in the right and left direction. Both end portions of an upper surface of the guide rail 12 in the right and left direction are provided with pulleys 13, 14. An endless belt 15 made of a rubber material is wound on the pulleys 13, 14. The right pulley 13 is connected with a carriage motor 16. When the carriage motor 16 is rotated in forward and reverse directions, the pulleys 13, 14 are rotated to travel the belt 15, so that the carriage 2 is reciprocally moved in the right and left direction, which is a scanning direction.

The head 3 is mounted on the carriage 2, and is configured to reciprocally move in the scanning direction together with the carriage 2. A lower surface of the head 3 is formed with a plurality of nozzles 5 for discharging inks. More specifically, the lower surface of the head 3 is formed with four nozzle rows 6 each of which has the plurality of nozzles 5 aligned in a row in the front and rear direction (the conveying direction). The respective nozzle rows 6 are aligned with constant intervals in the right and left direction. The four nozzle rows 6 are a nozzle row 6K for discharging black ink, a nozzle row 6Y for discharging yellow ink, a nozzle row 6C for discharging cyan ink, and a nozzle row 6M for discharging magenta ink, in corresponding order from the right. Also, the plurality of nozzles 5 of each nozzle row 6 is arranged so that positions thereof in the front and rear direction coincide with the plurality of nozzles 5 of the other nozzle rows 6.

In the head 3, ink flow paths configured to communicate with the plurality of nozzles 5 and an actuator having a plurality of drive elements configured to discharge the inks from the plurality of nozzles 5 by applying a pressure to the inks in the ink flow paths are provided. Although the actuator is not limited to the specific configuration, for example, a piezoelectric actuator having piezoelectric elements configured to pressurize the inks by using deformation resulting from an inverse piezoelectric effect of a piezoelectric layer, as the drive elements, may be favorably adopted. Also, an actuator having heat generators configured to heat the inks and to cause film boiling, as the drive elements, may also be adopted.

The conveyance mechanism 4 is a mechanism configured to convey forward a sheet P, which is a medium. The conveyance mechanism 4 includes a platen 41, conveying rollers 42, 43, a conveying motor 44 (refer to FIG. 2A), and the like.

The sheet P is placed on an upper surface of the platen 41. The conveying rollers 42, 43 are arranged in the front and rear direction with the platen 41 being interposed therebetween. The two conveying rollers 42, 43 are configured to synchronously drive by the conveying motor 44, thereby conveying forward the sheet P placed on the upper surface of the platen 41.

The touch panel 90 can receive a variety of operation inputs from a user and display a variety of setting screens, operation statuses and the like for the user. The image reading mechanism 95 includes a CCD, a CIS and the like, and is configured to perform an image reading operation of reading an image recorded on the sheet P in accordance with an instruction from the control device 100.

Figure 2A:
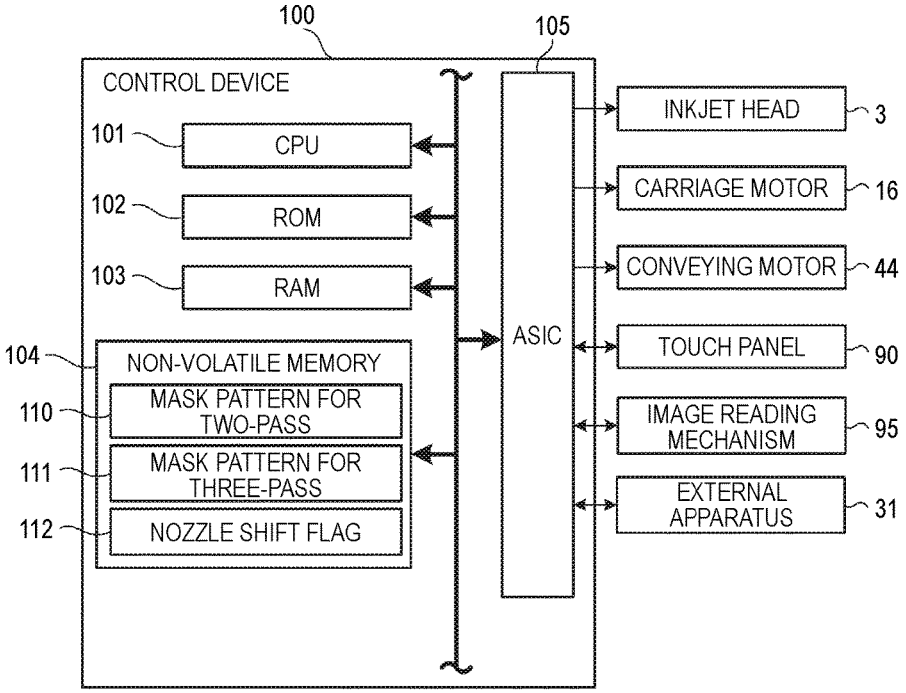
FIG. 2A is a block diagram depicting an electrical configuration of the printer.

As shown in FIG. 2A, the control device 100 includes a CPU (Central Processing Unit) 101, a ROM (Read Only Memory) 102, a RAM (Random Access Memory) 103, a non-volatile memory 104, an ASIC (application specific integrated circuit) 105, and the like. In the ROM 102, a program that is to be executed by the CPU 101, a variety of fixed data, and the like are stored. In the RAM 103, data (image data, and the like) that is necessary upon execution of the program is temporarily stored. In the non-volatile memory 104, a mask pattern 110 for two-pass, a mask pattern 111 for three-pass, a nozzle shift flag 112, and the like, which will be described later, are stored. The ASIC 105 is connected with diverse devices or drive units of the printer 1, such as the head 3, the carriage motor 16, the conveying motor 44, the touch panel 90, the image reading mechanism 95, and the like. Also, the ASIC 105 is connected to an external apparatus 31 such as a PC.

Hereinafter, it is described that a variety of processing is executed by the CPU. However, the CPU may be configured to execute the processing in cooperation with the ASIC. Also, the control device 100 may include a plurality of the CPUs, and the plurality of CPUs may be configured to execute the processing by sharing. Also, the control device 100 may include a plurality of ASICs, and the plurality of ASICs may be configured to execute the processing by sharing. Alternatively, one ASIC may be configured to singly execute the processing.

The CPU 101 is configured to execute the diverse processing by executing the program stored in the ROM 102 to control operations of the head 3, the carriage motor 16, the conveying motor 44 and the like via the ASIC 105. For example, the CPU 101 is configured to execute recording processing of controlling the head 3, the carriage motor 16, the conveying motor 44 and the like, and recording an image relating to the image data stored in the RAM 103 on the sheet P, based on a recording instruction received from the external apparatus 31.

In the below, the recording processing is described in detail. In the recording processing, the CPU 101 is configured to record an image on the sheet P by alternately and repetitively performing a recording pass of discharging the inks from the nozzles 5 of the head 3 to the sheet P while driving the carriage motor 16 to move the carriage 2 in the scanning direction and a conveying operation of conveying forward the sheet P by controlling the conveying motor 44. That is, the printer 1 is a so-called serial-type printer.

In the illustrative embodiment, discharge amounts of ink (volumes of ink droplets) that can be discharged from the nozzles 5 of the head 3 within one discharge cycle so as to record an image on the sheet P are four types (large droplets, medium droplets, small droplets, and non-discharge). Therefore, densities that can be expressed by dots to be formed by the inks spotted on the sheet P are only four steps of densities corresponding to the discharge amounts of ink. Like this, in the printer 1 of the illustrative embodiment, it is possible to perform a four-gradation recording for each dot region defined on the sheet P. Here, the discharge cycle is a time period that is required for the carriage 2 to move by a unit distance corresponding to a resolution in the scanning direction (the right and left direction).

Figure 2B:
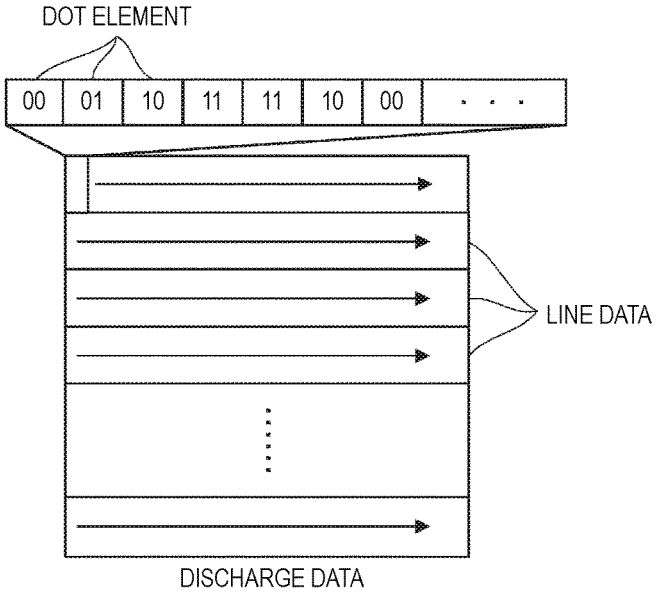
FIG. 2B illustrates discharge data.

As described above, in the RAM 103, the image data relating to an image that is to be recorded on the sheet P by the recording processing is stored. When executing the recording processing, the CPU 101 generates discharge data on the basis of the image data stored in the RAM 103. As shown in FIG. 2B, the discharge data has a plurality of dot elements corresponding to a plurality of dot formation regions demarcated into lattice shapes in the scanning direction and the conveying direction, in correspondence to a resolution in the scanning direction and a resolution in the conveying direction on the sheet P. For each dot element, a discharge amount of ink to be discharged to the corresponding dot formation region is set. In the illustrative embodiment, for each dot element, any one of the four discharge amounts (large droplets, medium droplets, small droplets, and non-discharge) is set. Meanwhile, in the discharge data shown in FIG. 2B, a dot element for which the large droplet is set is denoted with "11", a dot element for which the medium droplet is set is denoted with "10", a dot element for which the small droplet is set is denoted with "01", and a dot element for which the non-discharge is set is denoted with "00".

Also, the discharge data has a plurality of line data. Each line data is data including the plurality of dot elements corresponding to the plurality of dot formation regions aligned in the scanning direction (the right and left direction) on the sheet P. In each recording pass, each nozzle 5 is associated with any one line data. The ink is discharged from each nozzle 5 in accordance with the corresponding line data, so that an image of one line extending in the scanning direction (hereinafter, referred to as 'line image') is respectively recorded on the sheet P.

Here, in the illustrative embodiment, as the recording method with respect to the recording direction in the recording processing, a unidirectional recording method, in which the recording pass is performed by discharging the ink from the nozzles 5 only when the carriage 2 is moved toward one side (the right side, in the illustrative embodiment) in the scanning direction, and a bidirectional recording method, in which the recording pass is performed by discharging the ink from the nozzles 5 when the carriage 2 is moved toward one side and another side (the left side, in the illustrative embodiment) in the scanning direction, are used.

In the unidirectional recording method, after moving the carriage 2 rightward to execute one recording pass, a return operation of moving the carriage 2 leftward should be performed before starting a next recording pass. However, in the bidirectional recording method, it is not necessary to perform the return operation after executing one recording pass. That is, in the bidirectional recording method, the recording pass is executed, irrespective of the moving direction of the carriage 2. Therefore, the time necessary for the recording processing is shorter in the bidirectional recording method than in the unidirectional recording method.

In the meantime, during the recording pass, the discharge timing of the ink may deviate from an ideal timing. In the unidirectional recording method, during the recording processing, the moving direction of the carriage 2 in the recording pass is always the same. For this reason, even when the discharge timing of the ink deviates from the ideal timing in each recording pass, a deviation amount of ink spotting positions on the sheet P, which are to be recorded in each recording pass, in the scanning direction (the right and left direction) is small. On the other hand, in the bidirectional recording method, during the recording processing, the moving direction of the carriage 2 in the recording pass alternately changes. Therefore, in a case where the discharge timing of the ink deviates from the ideal timing in each recording pass, an ink spotting position on the sheet P, which is to be recorded in the recording pass when the carriage 2 moves rightward, and an ink spotting position on the sheet P, which is to be recorded in the recording pass when the carriage 2 moves leftward, largely deviate from each other in the scanning direction. Therefore, since the deviation amount of the ink spotting position in the scanning direction is smaller in the unidirectional recording method than in the bidirectional recording method, a quality of an image to be recorded on the sheet P is higher in the unidirectional recording method.

Here, when foreign matters (wastes and sand dusts) are attached in the vicinity of the nozzles 5 during the using of the printer, a nozzle shift that the ink discharged from the nozzle 5 is bent during flight occurs. When the nozzle shift occurs, a density irregularity extending in the scanning direction may be generated in an image to be recorded on the sheet P. The details will be described hereinafter. In the meantime, in order to simplify the description, it is assumed that the head 3 has one nozzle row 6 and the one nozzle row 6 has the six nozzles 5, as shown in FIG. 3A.

Figure 3A:
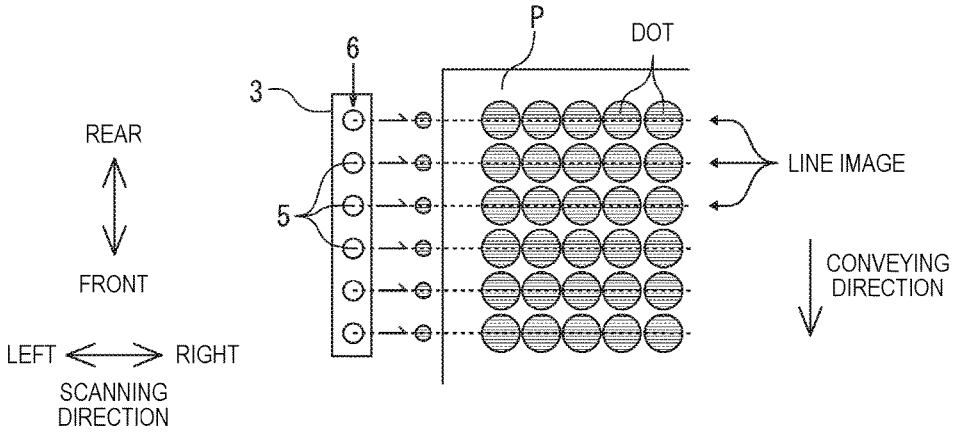
FIGS. 3A and 3B illustrate nozzle shift.

As shown in FIG. 3A, in a case where the recording pass is performed in a state where the nozzle shift does not occur in each of the six nozzles 5, a uniform image having no density irregularity is recorded on the sheet P. That is, the inks are discharged from the six nozzles 5, so that line images of six rows recorded on the sheet P are aligned with equal intervals in the conveying direction (the front and rear direction).

Figure 3B:
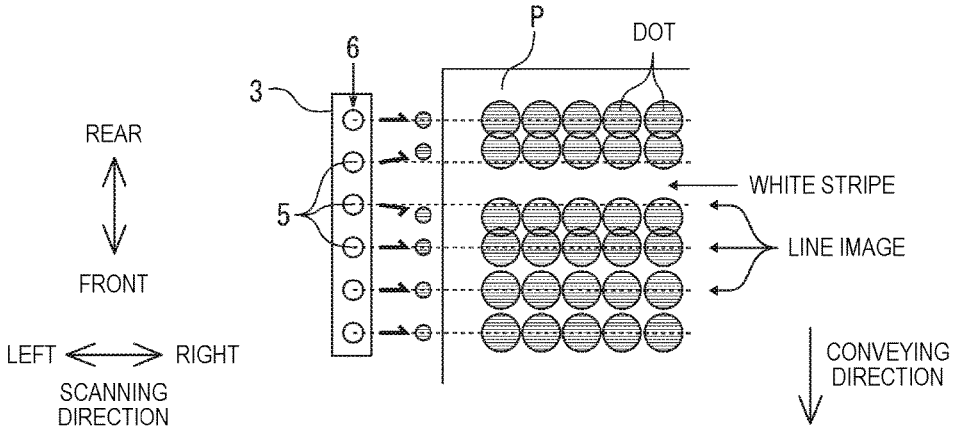

On the other hand, when the nozzle shift that the ink discharged from the nozzle 5 flies with being bent with respect to the conveying direction occurs in any one of the six nozzles 5, the line images of six rows recorded on the sheet P are not aligned with equal intervals in the front and rear direction and a density irregularity such as white stripe extending in the right and left direction is generated, as shown in FIG. 3B. As a result, a quality of an image recorded on the sheet P is deteriorated.

Figure 4A:
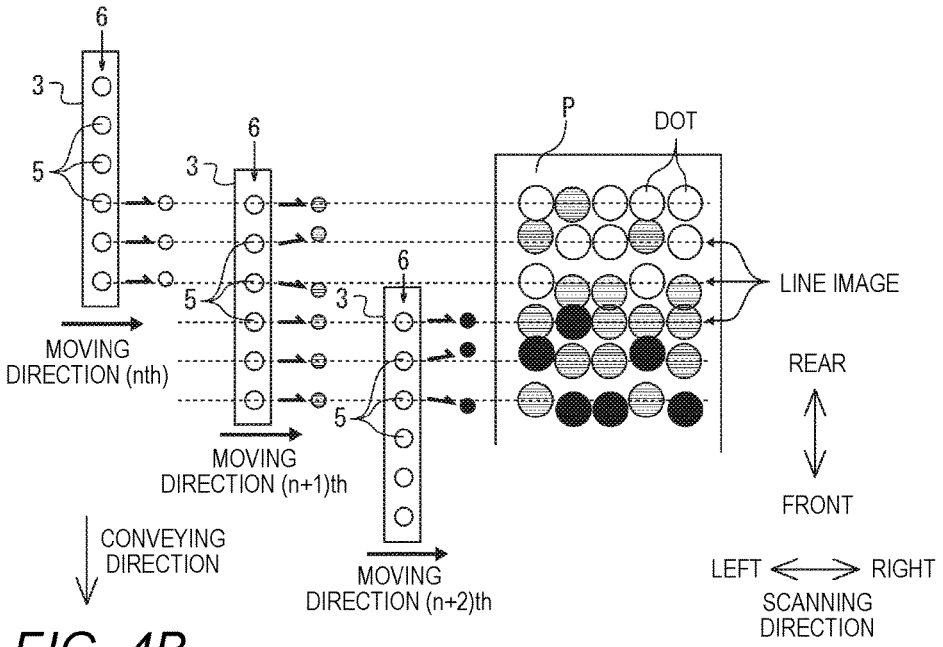
FIGS. 4A and 4B illustrate a first normal recording mode.

As measures against the density irregularity, a method of performing multi-pass processing during the recording processing has been known. The multi-pass processing is processing of completing one line image by recording a thinned-out image on the sheet P by using the different nozzles 5 in each of two or more recording passes, as shown in FIG. 4A. By the multi-pass processing, even in a case where there is the nozzle 5 for which the nozzle shift occurs, an inherent influence of each nozzle 5 on a recording image is reduced, so that the density irregularity such as white stripe extending in the right and left direction is not noticeable. That is, it is possible to suppress deterioration of a quality of an image to be recorded on the sheet P.

In the illustrative embodiment, as the multi-pass processing, two-pass/multi-pass processing of completing one line image by performing the recording pass two times and three-pass/multi-pass processing of completing one line image by performing the recording pass three times can be executed. Hereinafter, these multi-pass processing will be described in detail.

Figure 4B:
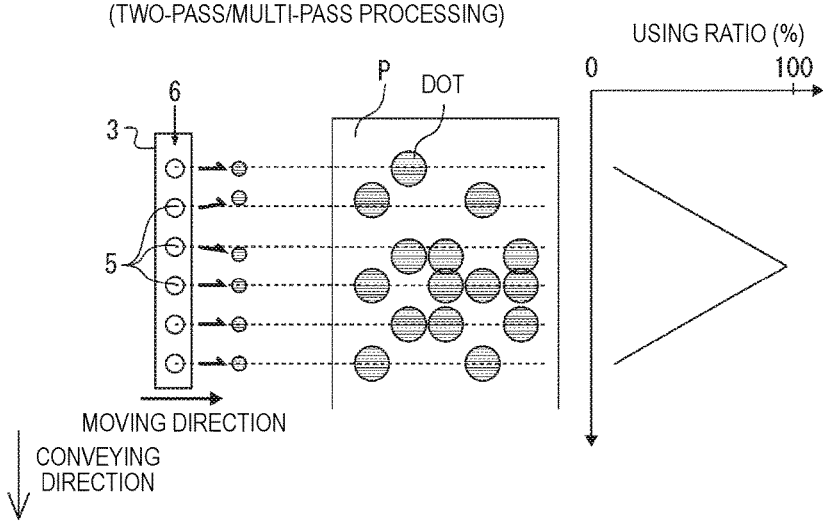

First, the two-pass/multi-pass processing is described with reference to FIGS. 4A, 4B, and 5A. In the two-pass/multi-pass processing, as shown in FIG. 4A, the CPU 101 conveys forward the sheet P only by a half of a length of the nozzle row 6 in the front and rear direction, in the conveying operation of the sheet P that is executed during the two consecutive recording passes. That is, positions of the three nozzles 5 during the previous recording pass in the front and rear direction, which are located at a downstream side of the nozzle row 6 with respect to the conveying direction, and positions of the three nozzles 5 during this recording pass in the front and rear direction, which are located at an upstream side of the nozzle row 6 with respect to the conveying direction, are made to be the same.

Figure 5A:
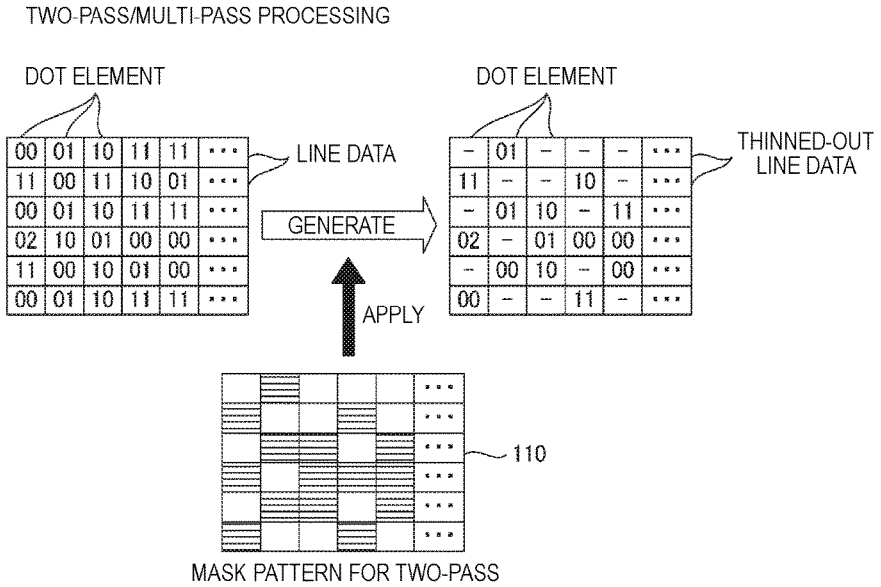
FIGS. 5A and 5B illustrate multi-pass processing.

Also, as shown in FIG. 5A, upon start of the recording processing, for each recording pass, the CPU 101 generates six thinned-out line data by thinning out six line data, which is used in each recording pass, in accordance with a mask pattern 110 for two-pass stored in the non-volatile memory 104. When executing each recording pass, the CPU 101 performs discharge control of inks on the basis of the six generated thinned-out line data. The mask pattern 110 for two-pass is data in which for each of the plurality of dot elements of the six line data to be used in this recording pass, it is determined whether or not to form a dot in a dot formation region corresponding to each dot element. Meanwhile, in the mask pattern 110 for two-pass shown in FIG. 5A, a dot element that permits dot formation in a corresponding dot formation region is shown with horizontal lines, and a dot element that does not permit dot formation in a corresponding dot formation region is shown with white.

By the above, in the two consecutive recording passes, three line images are completed by a thinned-out image recorded on the sheet P by using the three nozzles 5 located at the downstream side with respect to the conveying direction during the first recording pass and a thinned-out image recorded on the sheet P by using the three nozzles 5 located at the upstream side with respect to the conveying direction during the second recording pass.

The generation factors of the density irregularity extending in the scanning direction include a conveyance error upon conveyance of the sheet P, in addition to the nozzle shift. Hereinafter, the conveyance error will be described in detail.

In the two-pass/multi-pass processing, in the conveying operation of the sheet P that is executed during the two consecutive recording passes, the sheet P is conveyed forward only by the half of the length of the nozzle row 6 in the front and rear direction. For this reason, when the recording pass is consecutively performed three times, the sheet is conveyed by the length of the nozzle row 6 in the front and rear direction through the two conveying operations. In a case where a conveyance error occurs during the two conveying operations, a distance in the front and rear direction between a dot, which is recorded by the nozzle 5 formed at a downstream end portion of the nozzle row 6 with respect to the conveying direction in the first recording pass, and a dot, which is recorded by the nozzle 5 formed at an upstream end portion of the nozzle row 6 with respect to the conveying direction in the third recording pass, deviates from an ideal distance (a distance in the front and rear direction between two dots, which are recorded by the two adjacent nozzles 5 of the nozzle row 6). As a result, a density irregularity extending in the scanning direction is generated.

Therefore, in the illustrative embodiment, as measures against the density irregularity due to the conveyance error, the mask pattern 110 for two-pass is set so that upon recording of one line image, a using ratio (a ratio of the number of dots to be recorded by the nozzles 5 to a total number of dots of a line image) of the nozzles 5 located on the end portions of the nozzle row 6 is smaller than a using ratio of the nozzles 5 located on a central portion of the nozzle row 6. That is, as shown in FIG. 4B, the mask pattern 110 for two-pass is set so that during the recording pass, the using ratio of the nozzles 5 is larger at the nozzles 5 located on the central portion of the nozzle row 6 than at the nozzles 5 located on both end portions of the nozzle row 6. Thereby, it is possible to reduce a ratio of the dots to be recorded by the nozzles 5 located on both end portions of the nozzle row 6 to a total number of dots configuring one line image. As a result, it is possible to diminish the density irregularity due to the conveyance error. In the meantime, a graph of the using ratio of the nozzles shown at the right part of FIG. 4B indicates a relation between nozzle positions of the nozzle row 6 in the conveying direction and the using ratios of the nozzles 5 located at the nozzle positions.

Subsequently, the three-pass/multi-pass processing is described with reference to FIGS. 5B, 6A, and 6B. In the three-pass/multi-pass processing, as shown in FIG. 6A, the CPU 101 conveys forward the sheet P by one-third of the length of the nozzle row 6 in the front and rear direction, in the conveying operation of the sheet P that is executed during the two consecutive recording passes. That is, positions of the four nozzles 5 during the previous recording pass in the front and rear direction, which are located at the downstream side of the nozzle row 6 with respect to the conveying direction, and positions of the four nozzles 5 during this recording pass in the front and rear direction, which are located at the upstream side of the nozzle row 6 with respect to the conveying direction, are made to be the same.

Figure 5B:
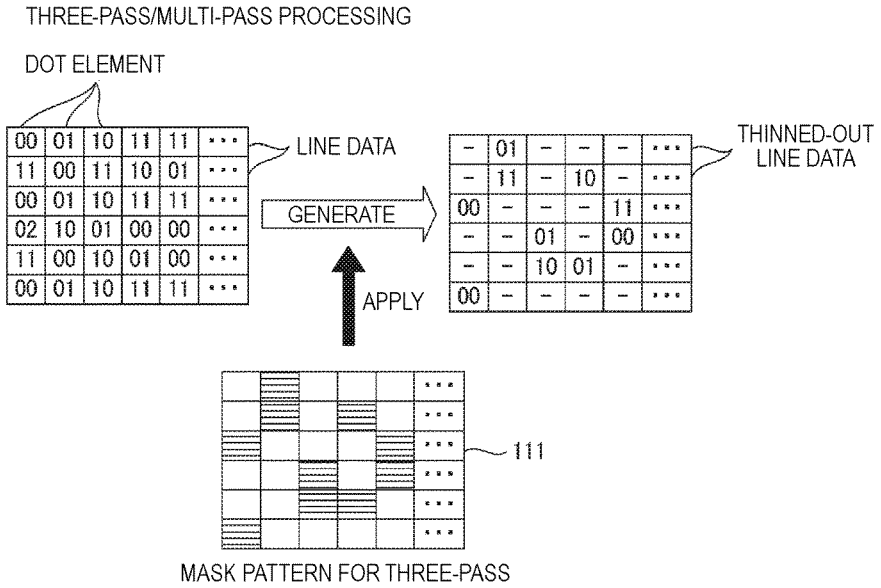
Figure 6A:
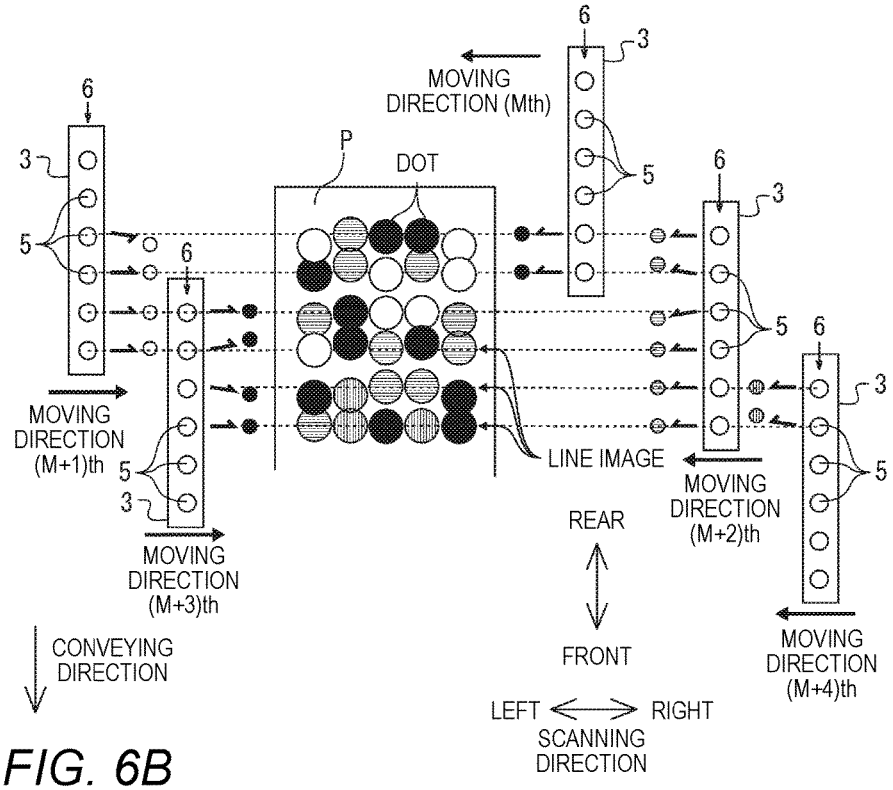
FIGS. 6A and 6B illustrate a second normal recording mode.
Figure 6B:
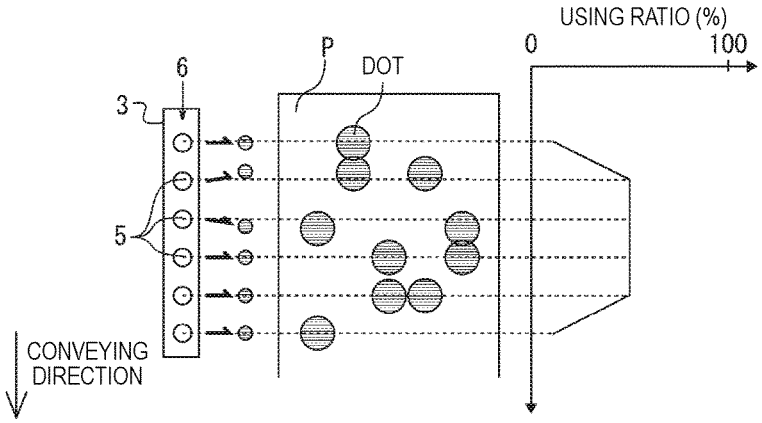

Also, as shown in FIG. 5B, upon start of the recording processing, for each recording pass, the CPU 101 generates six thinned-out line data by thinning out six line data, which is used in each recording pass, in accordance with a mask pattern 111 for three-pass stored in the non-volatile memory 104. When executing each recording pass, the CPU 101 performs discharge control of inks on the basis of the six generated thinned-out line data. The mask pattern 111 for three-pass is data in which for each of the plurality of dot elements of the six line data to be used in this recording pass, it is determined whether or not to form a dot in a dot formation region corresponding to each dot element, like the mask pattern for two-pass. However, the mask pattern 111 for three-pass is set so that the number of dot elements permitting dot formation in the corresponding dot formation regions is smaller than the mask pattern for two-pass.

By the above, in the three consecutive recording passes, two line images are completed by a thinned-out image recorded on the sheet P by using the two nozzles 5 located at the downstream side with respect to the conveying direction during the first recording pass, a thinned-out image recorded on the sheet P by using the two nozzles 5 located at the center side with respect to the conveying direction during the second recording pass, and a thinned-out image recorded on the sheet P by using the two nozzles 5 located at the upstream side with respect to the conveying direction during the third recording pass.

Also, like the mask pattern for two-pass, the mask pattern 111 for three-pass is set so that upon recording of one line image, the using ratio of the nozzles 5 is larger at the nozzles 5 located on the central portion of the nozzle row 6 than at the nozzles 5 located on both end portions of the nozzle row 6. Thereby, it is possible to diminish the density irregularity due to the conveyance error.

In the meantime, as shown in FIGS. 4A and 6A, in the three-pass/multi-pass processing, the number of the nozzles 5 to be used upon recording of one line image is larger than in the two-pass/multi-pass processing, so that an influence of the nozzles 5, at which the nozzle shift occurs, on a recording image is further reduced. Therefore, it is possible to further diminish the density irregularity extending in the scanning direction in the three-pass/multi-pass processing than in the two-pass/multi-pass processing.

As described above, when completing one line image, the more the number of times of the recording passes, it is possible to further diminish the density irregularity extending in the scanning direction, so that it is possible to suppress deterioration of a quality of an image to be recorded on the sheet P. However, when the number of times of the recording passes per one line image is increased, the throughput is lowered. Therefore, for example, in a case where one line image is recorded with the three-pass/multi-pass processing by the unidirectional recording method, although it is possible to suppress the deterioration of the image quality, the throughput is largely lowered.

Therefore, in the illustrative embodiment, as a recording mode of the recording processing, two recording modes capable of suppressing lowering of the throughput while suppressing deterioration of a quality of an image to be recorded on the sheet P are provided. That is, as the recording mode of the recording processing, a first normal recording mode and a second normal recording mode are provided.

The first normal recording mode is a recording mode in which the unidirectional recording method is adopted and one line image is recorded with the two-pass/multi-pass processing, as shown in FIGS. 4A and 7A. That is, the first normal recording mode is a recording mode in which a line image is completed by performing the recording pass two times and the recording pass is performed only when moving the carriage 2 toward one side in the scanning direction.

The second normal recording mode is a recording mode in which the bidirectional recording method is adopted and one line image is recorded with the three-pass/multi-pass processing, as shown in FIGS. 6A and 7A. That is, the second normal recording mode is a recording mode in which a line image is completed by performing the recording pass three times and the recording pass is performed irrespective of the moving direction of the carriage 2 in the scanning direction.

In the first normal recording mode, since the number of times of the recording passes to complete one line image is small, it is possible to suppress the lowering of the throughput. Also, in the first normal recording mode, since the recording pass is performed only when moving the carriage 2 toward one side in the scanning direction, it is possible to suppress the ink spotting position on the sheet P from deviating with respect to the scanning direction, as compared to the second normal recording mode. In contrast, in the second normal recording mode, since the number of times of the recording passes to complete one line image is large, it is possible to suppress the generation of the density irregularity extending in the scanning direction on the sheet P. Also, in the second normal recording mode, since the recording pass is performed irrespective of the moving direction of the carriage 2 in the scanning direction, it is possible to suppress the lowering of the throughput.

Also, in the illustrative embodiment, as the recording mode of the recording processing, a high-quality recording mode and a high-speed recording mode are provided, in addition to the first normal recording mode and the second normal recording mode.

The high-quality recording mode is a recording mode in which the unidirectional recording method is adopted and one line image is recorded with the three-pass/multi-pass processing, as shown in FIG. 7A. That is, the high-quality recording mode is a recording mode in which a line image is completed by performing the recording pass three times and the recording pass is performed only when moving the carriage 2 toward one side in the scanning direction. In the high-quality recording mode, since the number of times of the recording passes to complete one line image is large, it is possible to suppress the generation of the density irregularity extending in the scanning direction on the sheet P. In addition, since the recording pass is performed only when moving the carriage 2 toward one side in the scanning direction, it is possible to suppress the ink spotting position on the sheet P from deviating with respect to the scanning direction. Therefore, the high-quality recording mode is a recording mode in which it is possible to further suppress the deterioration of a quality of an image to be recorded on the sheet P, as compared to the first normal recording mode and the second normal recording mode. On the other hand, in the high-quality recording mode, the throughput is lowered, as compared to the first normal recording mode and the second normal recording mode.

The high-speed recording mode is a recording mode in which the bidirectional recording mode is adopted and one line image is not recorded with the multi-pass processing but is recorded with one recording pass (i.e., single pass), as shown in FIG. 7A. Also, in the high-speed recording mode, the moving speed of the carriage 2 during the recording pass is higher than the first normal recording mode, the second normal recording mode and the high-quality recording mode. Therefore, in the high-speed recording mode, as compared to the first normal recording mode and the second normal recording mode, the throughput is higher but a quality of an image to be recorded on the sheet P is deteriorated.

The CPU 101 is configured to determine one of the four recording modes in which the recording processing is to be executed, based on predetermined conditions. In the illustrative embodiment, the predetermined conditions include a recording instruction condition and a sheet type condition.

The recording instruction condition is a condition relating to a recording instruction received from the external apparatus 31. The recording instruction received from the external apparatus 31 includes a normal recording instruction, a high-quality recording instruction, and a high-speed recording instruction. The normal recording instruction is a recording instruction for instructing an image to be recorded at a normal recording speed and with a normal resolution (recording resolution) in the conveying direction (front and rear direction). The high-quality recording instruction is a recording instruction for instructing an image to be recorded with a resolution higher than the normal resolution in the conveying direction. Also, the high-speed recording instruction is a recording instruction for instructing an image to be recorded at a recording speed higher than the normal recording speed.

In a case where a recording instruction received from the external apparatus 31 is the normal recording instruction, the CPU 101 determines that the recording processing is to be executed in one of the first normal recording mode and the second normal recording mode, as shown in FIG. 7B. Also, in a case where the recording instruction is the high-quality recording instruction, the CPU 101 determines that the recording processing is to be executed in the high-quality recording mode, and in a case where the recording instruction is the high-speed recording instruction, the CPU 101 determines that the recording processing is to be executed in the high-speed recording mode. In the meantime, when the high-quality recording instruction is received, the CPU 101 generates discharge data on the basis of the image data stored in the RAM 103 so that the number of dots of an image to be recorded on the sheet P in the conveying direction is larger than a case where the normal recording instruction is received. That is, the number of line data of the discharge data, which is generated when the high-quality recording instruction is received, is larger, as compared to a case where the normal recording instruction is received. Also, in a case where the high-quality recording instruction is received, in the recording processing, the CPU 101 reduces a conveyance amount of conveying the sheet P in the conveying operation, which is executed during the consecutive recording passes in the recording processing, in correspondence to the recording resolution in the conveying direction, as compared to a conveyance amount when the normal recording instruction is received.

The sheet type condition is a condition relating to a type of the sheet P. In the illustrative embodiment, the type of the sheet P includes two types of an inkjet sheet and a glossy sheet. The inkjet sheet is a sheet configured by a base material of paper and an ink absorption layer for coating a surface of the base material. The ink absorption layer may be a swelling-type ink absorption layer containing a hydrophilic resin or a void-type ink absorption layer including porous particles and having a fine void structure formed therein. As the glossy sheet, a resin glossy sheet configured by a base material made of a film such as PET and a void-type ink absorption layer for coating a surface of the base material may be exemplified. A thickness of the ink absorption layer of the resin glossy sheet is larger than a thickness of the ink absorption layer of the inkjet sheet because the film of the base material does not absorb the ink, for example. In the below, the resin glossy sheet is described as the glossy sheet.

The glossy sheet is a sheet into which the ink is more difficult to infiltrate, as compared to the inkjet sheet. Here, the ink spotted on the sheet P soaks in the sheet P, so that it becomes larger than a size (area) of the dot upon the spotting. An increase ratio of the dot size is smaller in a sheet into which the ink is more difficult to infiltrate. For this reason, the increase ratio is smaller in the glossy sheet than in the inkjet sheet. As a result, upon the recording of an image on the sheet P with the same conditions except the type of the sheet P, in a case where the sheet P is the glossy sheet, the increase ratio of the dot size is smaller, as compared to a case where the sheet P is the inkjet sheet, so that the density irregularity such as white stripe extending in the scanning direction is likely to be noticeable.

Therefore, in the case that the recording instruction is the normal recording instruction, in a case where the sheet P is the inkjet sheet, the CPU 101 determines that the recording processing is to be executed in the first normal recording mode, and in a case where the sheet P is the glossy sheet, the CPU 101 determines that the recording processing is to be executed in the second normal recording mode.

Also, in the illustrative embodiment, the predetermined conditions for determining the recording mode of the recording processing include a nozzle condition, in addition to the recording instruction condition and the sheet type condition.

The nozzle condition is a condition of a nozzle state of the plurality of nozzles 5 of the head 3, which relates to a bending amount of the ink discharged from the nozzles 5 with respect to the conveying direction. In a case where the nozzle state of the plurality of nozzles 5 is poor, the density irregularity extending in the scanning direction is noticeable even though one line image is recorded with the two-pass/multi-pass processing.

Therefore, in a case that the recording instruction is the normal recording instruction, when the nozzle state of the plurality of nozzles 5 is a normal state, the CPU 101 determines whether the recording processing is to be executed in the first normal recording mode or the second normal recording mode, in accordance with the sheet type condition. On the other hand, in a case where the nozzle state of the plurality of nozzles 5 is a nozzle shift state, which is worse than the normal state, the CPU 101 determines that the recording processing is to be executed in the second normal recording mode, irrespective of the sheet type condition. Here, the nozzle shift state is a state where the nozzle shift occurs to such a degree that the density irregularity extending in the right and left direction can be visually recognized by the user when an image is recorded on the sheet P with the two-pass/multi-pass processing.

Here, the nozzle state relating to the plurality of nozzles 5 is acquired as follows. That is, the CPU 101 records a test pattern for deciding the nozzle state relating to the plurality of nozzles 5 on the sheet P. At this time, in order to easily decide the nozzle state, the recording of the test pattern on the sheet P is performed in such a way that each line image is completed by one recording pass, as shown in FIG. 3A, without performing the multi-pass processing. Thereafter, the CPU 101 reads the test pattern recorded on the sheet P by the image reading mechanism 95 and analyzes the read test pattern, thereby acquiring the nozzle state relating to the plurality of nozzles 5. Thereby, it is possible to accurately acquire the nozzle state relating to the plurality of nozzles 5.

(Processing Operation of Inkjet Printer)

Figure 8A:
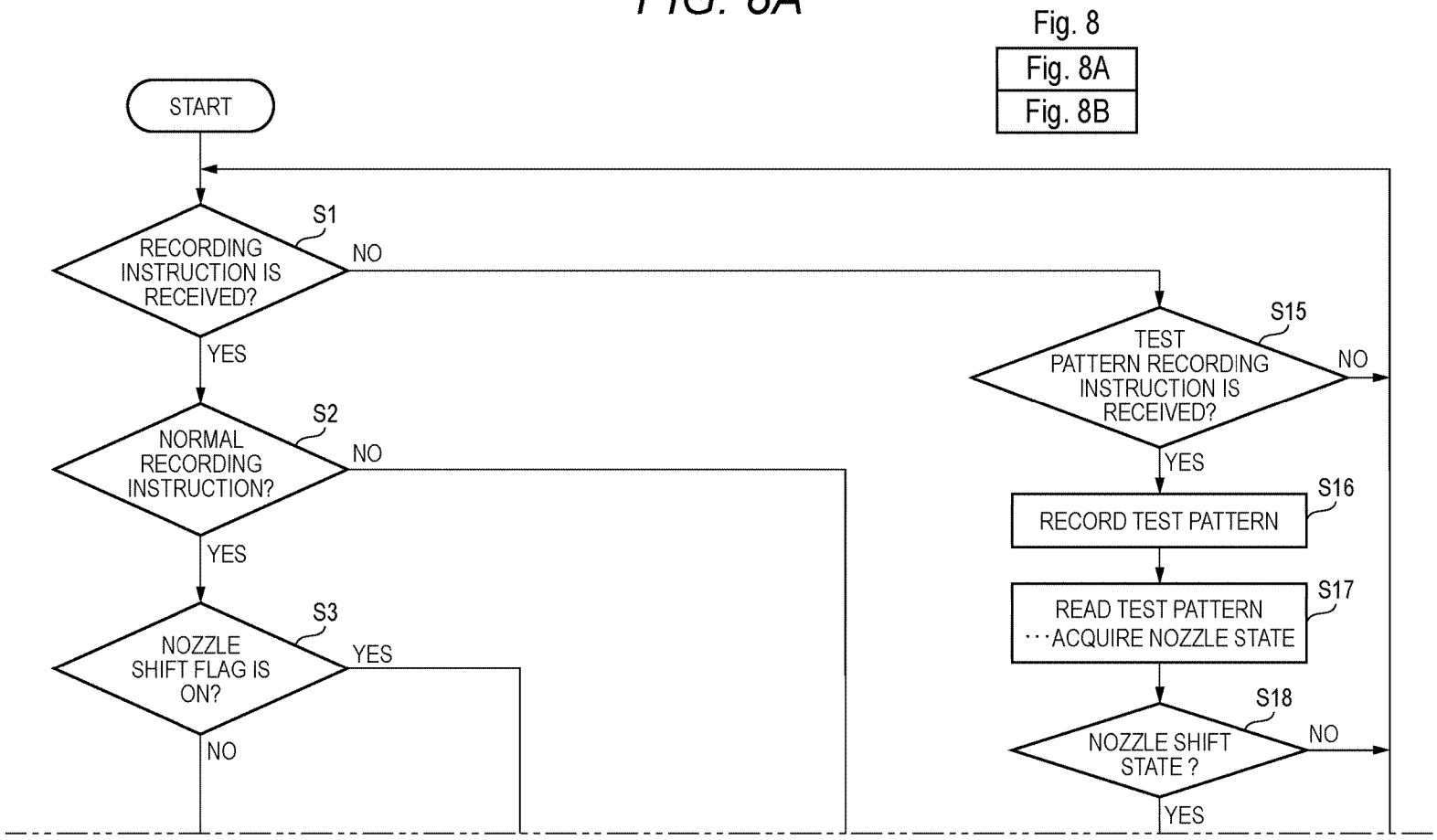
FIGS. 8A and 8B illustrates an operation of the inkjet printer.
Figure 8B:
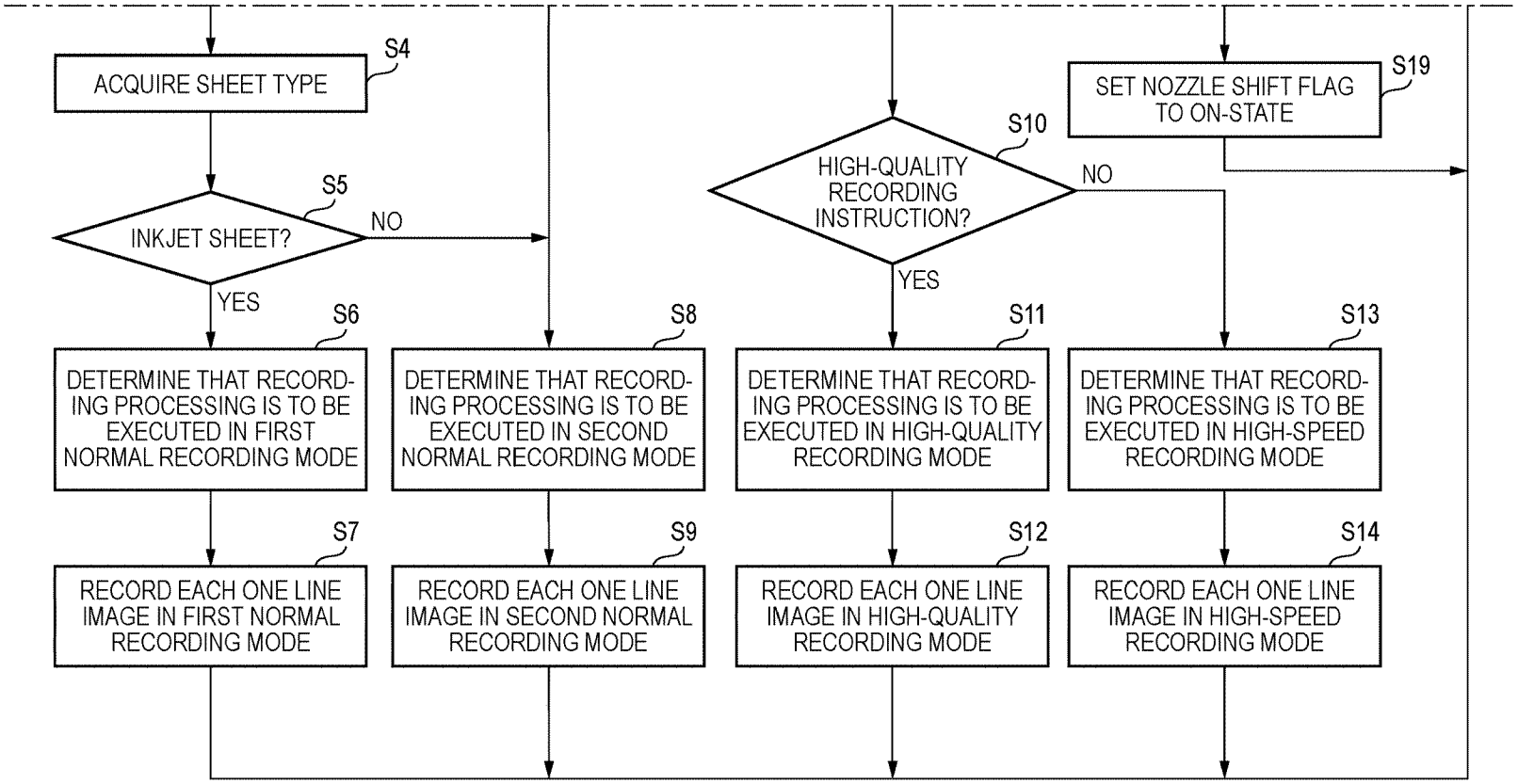

Subsequently, an example of the processing operation of the inkjet printer 1 is described with reference to FIGS. 8A and 8B.

The CPU 101 determines whether a recording instruction is received from the external apparatus 31 (S1). In a case where it is determined that the recording instruction is received (S1: YES), the CPU 101 determines whether the recording instruction is a normal recording instruction (S2). In a case where it is determined that the recording instruction is the normal recording instruction (S2: YES), the CPU 101 determines whether a nozzle shift flag 112 stored in the non-volatile memory 104 is at an on-state (S3). The nozzle shift flag 112 is a flag that is at an off-state when the nozzle state of the plurality of nozzles 5 is the normal state and is at an on-state when the nozzle state is the nozzle shift state.

In a case where it is determined that the nozzle shift flag 112 is not at the on-state (i.e., the nozzle shift flag 112 is at the off-state) (S3: NO), the CPU 101 acquires the type of the sheet P based on the received recording instruction (S4), and determines whether the acquired type of the sheet P is an inkjet sheet (S5). In a case where it is determined that the type of the sheet P is the inkjet sheet (S5: YES), the CPU 101 determines that the recording processing is to be executed in the first normal recording mode (S6). Then, the CPU 101 controls the head 3, the carriage motor 16, the conveying motor 44 and the like to execute the recording processing of recording each line image in the first normal recording mode (S7). When the recording processing of S7 is over, the CPU 101 returns to the processing of S1.

In a case where it is determined in the processing of S3 that the nozzle shift flag 112 is at the on-state (S3: YES) or in a case where it is determined in the processing of S5 that the type of the sheet P is not the inkjet sheet (i.e., the type of the sheet is a glossy sheet) (S5: NO), the CPU 101 determines that the recording processing is to be executed in the second normal recording mode (S8). Then, the CPU 101 controls the head 3, the carriage motor 16, the conveying motor 44 and the like to execute the recording processing of recording each line image in the second normal recording mode (S9). When the recording processing of S9 is over, the CPU 101 returns to the processing of S1.

In a case where it is determined in the processing of S2 that the recording instruction received from the external apparatus 31 is not the normal recording instruction (S2: NO), the CPU 101 determines whether the recording instruction is a high-quality recording instruction (S10). In a case where it is determined that the recording instruction is the high-quality recording instruction (S10: YES), the CPU 101 determines that the recording processing is to be executed in the high-quality recording mode (S11). Then, the CPU 101 controls the head 3, the carriage motor 16, the conveying motor 44 and the like to execute the recording processing of recording each line image in the high-quality recording mode (S12). When the recording processing of S12 is over, the CPU 101 returns to the processing of S1.

In a case where it is determined in the processing of S10 that the recording instruction received from the external apparatus 31 is not the high-quality recording instruction (S10: NO), the CPU 101 determines that the recording instruction is a high-speed recording instruction and that the recording processing is to be executed in the high-speed recording mode (S13). Then, the CPU 101 controls the head 3, the carriage motor 16, the conveying motor 44 and the like to execute the recording processing of recording each line image in the high-speed recording mode (S14). When the recording processing of S14 is over, the CPU 101 returns to the processing of S1.

In a case where it is determined in the processing of S1 that the recording instruction is not received from the external apparatus 31 (S1: NO), the CPU 101 determines whether a recording instruction of the test pattern is received from the user via the touch panel 90 (S15). In a case where it is determined that the recording instruction of the test pattern is received (S15: YES), the CPU 101 controls the head 3, the carriage motor 16, the conveying motor 44 and the like to record a test pattern for deciding the nozzle state relating to the plurality of nozzles 5 on the sheet P (S16). Thereafter, the CPU 101 reads the test pattern recorded on the sheet P by the image reading mechanism 95 and analyzes the read test pattern, thereby acquiring the nozzle state (S17). Thereafter, the CPU 101 determines whether the acquired nozzle state is the nozzle shift state (S18).

In a case where it is determined that the acquired nozzle state is not the nozzle shift state (S18: NO), the CPU 101 returns to the processing of S1. On the other hand, in a case where it is determined that the acquired nozzle state is the nozzle shift state (S18: YES), the CPU 101 sets the nozzle shift flag 112 stored in the non-volatile memory 104 to the on-state (S19), and returns to the processing of S1.

According to the illustrative embodiment, in the second normal recording mode, since the number of times of the recording passes is large, it is possible to suppress the stripe-shaped density irregularity extending in the scanning direction from being generated on the sheet P. Also, in the second normal recording mode, since the recording pass is performed irrespective of the moving direction of the carriage 2 in the scanning direction, it is possible to suppress the throughput from being lowered. On the other hand, in the first normal recording mode, since the number of times of the recording passes is small, it is possible to suppress the throughput from being lowered. Also, in the first normal recording mode, since the recording pass is performed only when the carriage 2 is moved toward one side in the scanning direction, it is possible to suppress the ink spotting position on the sheet P from deviating with respect to the scanning direction, as compared to the second normal recording mode.

Also, in a case where the type of the sheet P is the glossy sheet into which the ink is difficult to infiltrate, the recording is performed in the second normal recording mode, so that it is possible to suppress the deterioration of the image quality. In addition to this, in a case where the nozzle state of the plurality of nozzles is the nozzle shift state, even though the type of the sheet P is the inkjet sheet into which the ink can easily infiltrate, the recording is performed in the second normal recording mode, so that it is possible to more securely suppress the deterioration of the image quality.

In the illustrative embodiment, the conveyance mechanism 4 corresponds to "conveyer". The inkjet head 3 corresponds to "recording head". The CPU 101 corresponds to "controller". The first normal recording mode corresponds to "first recording mode", and the second normal recording mode corresponds to "second recording mode". The high-quality recording mode corresponds to "third recording mode", and the high-speed recording mode corresponds to "fourth recording mode".

Although the preferable illustrative embodiment of the present disclosure has been described, the present disclosure is not limited to the illustrative embodiment and a variety of changes can be made without departing from the scope of the claims. For example, even when the recording instruction is the high-speed printing mode, in a case where the nozzle state of the plurality of nozzles 5 is the nozzle shift state, any one of the second normal recording mode and the high-quality recording mode may be executed, not the high-speed printing mode.

In the above illustrative embodiment, the nozzle state relating to the plurality of nozzles 5 is acquired by reading the test pattern recorded on the sheet P by the image reading mechanism 95 and analyzing the same. However, the present disclosure is not limited thereto. For example, the nozzle state may be acquired on the basis of an operation, which is input via the touch panel 90 from the user who visually recognizes the test pattern recorded on the sheet P.

In the high-quality recording mode, the number of times of the recording passes to complete one line image is the same (two times) as that in the second normal recording mode. However, the number of times of the recording passes may be larger than that in the second normal recording mode. Also, in the above illustrative embodiment, the high-quality recording instruction is the recording instruction for instructing an image to be recorded on the sheet P with the recording resolution being increased in the conveying direction, as compared to the normal recording instruction. However, the present disclosure is not limited thereto. For example, the high-quality recording instruction may be a recording instruction for instructing an image to be recorded on the sheet P with the recording resolution being increased in the scanning direction, as compared to the normal recording instruction.

Also, in the above illustrative embodiment, in a case where the recording instruction is the normal recording instruction, it is determined whether the recording processing is to be executed in either of the first normal recording mode and the second normal recording mode, in accordance with whether the type of the sheet P is the inkjet sheet or the glossy sheet. However, the present disclosure is not particularly limited thereto. For example, as the type of the glossy sheet, there is a cast glossy sheet, in addition to the above-described resin glossy sheet. The cast glossy sheet is a sheet configured by a base material of paper, a void-type ink absorption layer formed on the base material, and a glossy layer formed on the ink absorption layer. The cast glossy sheet is a sheet into which the ink can easily infiltrate, as compared to the resin glossy sheet. Therefore, when the recording instruction is the normal recording instruction, in a case where it is determined that the type of the sheet P is any one of the inkjet sheet and the cast glossy sheet, the CPU 101 may determine that the recording processing is to be executed in the first normal recording mode, and in a case where it is determined that the type of the sheet P is the resin glossy sheet, the CPU 101 may determine that the recording processing is to be executed in the second normal recording mode.

Also, in the above illustrative embodiment, the number of times of the recording passes to complete one line image is two times in the first normal recording mode, and is three times in the second normal recording mode. However, the present disclosure is not particularly limited thereto. For example, the number of times of the recording passes to complete one line image may be three or more times in the first normal recording mode, and may be four or more times in the second normal recording mode. Also, in a case where the number of times of the recording passes to complete one line image is three or more times in the first normal recording mode, when the number of times of the recording passes to complete one line image in the high-speed recording mode is smaller than that in the first normal recording mode, the one line image may be completed by the multi-pass processing.

Also, in the illustrative embodiment, the present disclosure is applied to the printer configured to print an image on the sheet P by discharging the inks from the nozzles. However, the present disclosure is not limited thereto. For example, the present disclosure can be applied to a liquid discharge apparatus configured to perform the printing by discharging liquid other than the ink, such as a material of a wiring pattern to be printed on a wiring substrate.

What is claimed is:

1. An image recording apparatus comprising:

a conveyer configured to convey a medium in a conveying direction;

a recording head including a nozzle row including a plurality of nozzles aligned in the conveying direction;

a carriage on which the recording head is mounted, the carriage being configured to reciprocally move in a scanning direction intersecting with the conveying direction; and a controller configured to:

record an image on the medium by alternately performing: a recording pass of causing the recording head to discharge liquid from the nozzles toward the medium while moving the carriage in the scanning direction; and conveying of causing the conveyer to convey the medium in the conveying direction, wherein the recording of the image includes multi-pass recording of completing a line image by performing the recording pass a plurality of number of times, the line image being an image of one line extending in the scanning direction to be recorded on the medium, each recording pass being performed by recording a thinned-out image on the medium by using a nozzle among the plurality of nozzles, and a nozzle used in one recording pass being different from a nozzle used in another recording pass, and wherein the controller is configured to record the image in:

a first recording mode in which the multi-pass recording of completing the line image is executed by performing the recording pass a first number of times, the recording pass being performed only when moving the carriage toward one side in the scanning direction; and a second recording mode in which the multi-pass recording of completing the line image is executed by performing the recording pass a second number of times larger than the first number of times, the recording pass being performed when moving the carriage toward the one side in the scanning direction and another side in the scanning direction.

2. The image recording apparatus according to claim 1, wherein the controller is further configured to:

acquire a type of the medium, and wherein the controller is configured to execute the recording of the image in the first recording mode in a case where the type of the medium which has been acquired is a first medium, and execute the recording of the image in the second recording mode in a case where the type of the medium is a second medium into which the liquid is more difficult to infiltrate than the first medium.

3. The image recording apparatus according to claim 2, wherein the first medium is a glossy sheet including a first base material and a first liquid absorption layer coating the first base material, wherein the second medium is an inkjet sheet including a second base material and a second liquid absorption layer coating the second base material, and wherein a thickness of the second liquid absorption layer is greater than a thickness of the first liquid absorption layer.

4. The image recording apparatus according to claim 1, wherein the controller is further configured to record the image in:

a third recording mode in which the multi-pass recording of completing the line image is executed by performing the recording pass the second number of times or more, the recording pass being performed only when moving the carriage toward the one side in the scanning direction, and wherein the controller is configured to record the image in either of the first recording mode and the second recording mode in a case where a recording resolution in the conveying direction of an image to be recorded on the medium is a first resolution, and record the image in the third recording mode in a case where the recording resolution in the conveying direction is a second resolution higher than the first resolution.

5. The image recording apparatus according to claim 1, wherein the controller is further configured to:

acquire a nozzle state of the plurality of nozzles, which relates to a bending amount of the liquid discharged from the nozzles with respect to the conveying direction, and wherein the controller is configured to record the image in the first recording mode in a case where the nozzle state which has been acquired is a first state, and record the image in the second recording mode in a case where the nozzle state which has been acquired is a second state in which the bending amount is larger than in the first state.

6. The image recording apparatus according to claim 5, further comprising a scanner, wherein, when acquiring the nozzle state of the plurality of nozzles, the controller is configured to:

control the conveyer, the recording head, and the carriage to record a test pattern on the medium;

cause the scanner to read the test pattern recorded on the medium; and analyze the read test pattern.

7. The image recording apparatus according to claim 1, wherein the controller is further configured to record the image in:

a fourth recording mode in which a moving speed of the carriage in the scanning direction during the recording pass is higher than in the first recording mode and the second recording mode, either the multi-pass recording of completing the line image by performing the recording pass a plurality of number of times less than the first number of times or a single-pass recording of completing the line image by performing the recording pass once being performed, and the recording pass being performed when moving the carriage toward the one side in the scanning direction and the other side in the scanning direction.

8. The image recording apparatus according to claim 1, wherein in the multi-pass recording, a plurality of the thinned-out images corresponding to a plurality of the line images aligned in the conveying direction is recorded on the medium by using a plurality of the nozzles in each of the recording passes performed for a plurality of number times, and the controller is configured to set a using ratio of the nozzle located on an end portion of the nozzle row to be smaller than a using ratio of the nozzle located on a central portion of the nozzle row upon recording of one line image.

9. The image recording apparatus according to claim 1, wherein the controller is further configured to record the image in:

a third recording mode in which the multi-pass recording of completing the line image is executed by performing the recording pass the second number of times or more, the recording pass being performed only when moving the carriage toward the one side in the scanning direction; and a fourth recording mode in which a moving speed of the carriage in the scanning direction during the recording pass is higher than in the first recording mode and the second recording mode, either the multi-pass recording processing of completing the line image by performing the recording pass a plurality of number of times less than the first number of times or a single-pass recording processing of completing the line image by performing the recording pass once being performed, and the recording pass being performed when moving the carriage toward the one side in the scanning direction and the other side in the scanning direction, wherein the controller is further configured to:

acquire a nozzle state of the plurality of nozzles, which relates to a bending amount of the liquid discharged from the nozzles with respect to the conveying direction, and wherein, in a case of receiving an instruction of recording the image in the fourth recording mode, the controller is configured to:

if the acquired nozzle state of the plurality of nozzles does not satisfy a predetermined condition, record the image in the fourth recording mode; and if the acquired nozzle state of the plurality of nozzles satisfies the predetermined condition, record the image in one of the second recording mode and the third recording mode instead of the fourth recording mode.

10. The image recording apparatus according to claim 1, wherein the controller is further configured to record the image in:

a third recording mode in which the multi-pass recording of completing the line image is executed by performing the recording pass the second number of times or more, the recording pass being performed only when moving the carriage toward the one side in the scanning direction, and wherein the controller is configured to record the image in either of the first recording mode and the second recording mode in a case where a recording resolution in the scanning direction of an image to be recorded on the medium is a first resolution, and execute the recording processing in the third recording mode in a case where the recording resolution in the scanning direction is a second resolution higher than the first resolution.

11. The image recording apparatus according to claim 1, wherein the first number of times is two times, and the second number of times is three times.

* * * * *